US011596578B2

(12) United States Patent
Tian et al.

(10) Patent No.: US 11,596,578 B2
(45) Date of Patent: Mar. 7, 2023

(54) PILL GRINDER AND METHOD FOR USING THEREOF

(71) Applicant: Song Yang, Shanghai (CN)

(72) Inventors: Hongliang Tian, Changshu (CN); Song Yang, Shanghai (CN)

(73) Assignee: Song Yang, Shanghai (CN)

( * ) Notice: Subject to any disclaimer, the term of this patent is extended or adjusted under 35 U.S.C. 154(b) by 171 days.

(21) Appl. No.: 17/169,488

(22) Filed: Feb. 7, 2021

(65) Prior Publication Data

US 2021/0393485 A1 Dec. 23, 2021

(30) Foreign Application Priority Data

Jun. 17, 2020 (CN) ..... 202010554237.X

(51) Int. Cl.

*B02C 4/12* (2006.01)
*A61J 7/00* (2006.01)
*B02C 4/42* (2006.01)

(52) U.S. Cl.

CPC ..... *A61J 7/0007* (2013.01); *B02C 4/12* (2013.01); *B02C 4/42* (2013.01)

(58) Field of Classification Search

CPC . A61J 7/0007; B02C 4/12; B02C 4/42; B02C 4/30; B02C 4/28

See application file for complete search history.

(56) References Cited

U.S. PATENT DOCUMENTS 6,059,209 A * 5/2000 Barson ..... A61J 7/0007 241/168
7,032,851 B2 * 4/2006 Demske ..... B02C 4/02 241/DIG. 27
7,252,254 B1 * 8/2007 Engel ..... A61J 7/0007 241/168

(Continued)

FOREIGN PATENT DOCUMENTS

CN 103417381 A 12/2013
CN 104739652 A 7/2015

(Continued)

OTHER PUBLICATIONS

1st Office Action dated Jul. 28, 2022 of Chinese Application No. 202010554237.X.

*Primary Examiner* — Faye Francis
(74) *Attorney, Agent, or Firm* — Qinghong Xu

(57) ABSTRACT

A pill grinder and a method for using thereof are provided. The pill grinder includes: a base plate; a guiding assembly; a handle component including a pair of handle connecting rods, wherein, a first connecting rod is connected to a first end of each handle connecting rod, a roller shaft is connected between the handle connecting rods, axial directions of the roller shaft and the first connecting rod are both parallel to a first direction, the first connecting rod is kept pressed towards the base plate by an elastic returning component; and a grinding component, sleeved outside the roller shaft. When the handle component rotates around the first connecting rod, guided by the guiding assembly, the (Continued)

grinding component has a grinding stroke along a second direction perpendicular to the first direction. Therefore, pills can be better grinded with easier operation and less time, and safety in use is largely enhanced.

16 Claims, 17 Drawing Sheets

(56) References Cited

U.S. PATENT DOCUMENTS

| | | | | |
|---|---|---|---|---|
| 7,407,124 | B1 * | 8/2008 | Layshon | A61J 7/0007 241/DIG. 27 |
| 7,559,496 | B2 * | 7/2009 | Shewchuk | A61J 7/0007 241/DIG. 27 |
| 9,180,071 | B2 * | 11/2015 | Wheeler | A61J 7/0007 |
| 2005/0127218 | A1 * | 6/2005 | Demske | A61J 7/0007 241/169 |
| 2008/0093490 | A1 * | 4/2008 | Donovan | A61J 7/0007 241/169.2 |
| 2012/0187229 | A1 * | 7/2012 | Clouser | B02C 1/04 241/30 |
| 2015/0274343 | A1 * | 10/2015 | Kim | B02C 1/14 241/199.9 |

FOREIGN PATENT DOCUMENTS

| | | | |
|---|---|---|---|
| CN | 204841879 | U | 12/2015 |
| CN | 106377430 | A | 2/2017 |
| CN | 206688819 | U | 12/2017 |
| CN | 206868386 | U | 1/2018 |
| CN | 207493835 | U | 6/2018 |
| DE | 10324951 | A1 | 12/2004 |

* cited by examiner

PILL GRINDER AND METHOD FOR USING THEREOF

CROSS-REFERENCE TO RELATED APPLICATIONS

This application is based upon and claims priority to Chinese Patent Application No. 202010554237.X, filed on Jun. 17, 2020, the entire contents of which are incorporated herein by reference.

TECHNICAL FIELD

The present disclosure relates to a medical auxiliary device, and more particularly to a pill grinder and a method for using thereof.

BACKGROUND

"Safety of patients taking medicine" is an important subject for various medical institutions, however, inappropriate dose is a potential risk when the aged and the infants take medicine. Inappropriate dose taken by the aged may occur when the dose or the frequency is higher than a recommended value, and inappropriate dose taken by the infants may occur for the reason that the physiological development of the infants is not very mature and large differences exist between the infants and adults in the aspects of medicine absorption, distribution, metabolism, and excretion. If the medicine is taken in a wrong way, the healing situation will be influenced seriously.

During the treatment and prevention of various diseases, taking medicine or health food (which are both called medicine in the following) is a most direct and effective treating and preventing method. Normally, the medicine and the health food can be taken orally, by injection, or applied externally, etc. Wherein, the oral medicine is a kind of medicine that is easy to preserve and carry, so the oral medicine is a commonly used kind of medicine. The oral medicine has the forms of pills, capsules, powders, etc. The pill is molded to a shape of round, ellipse, or polygon, which is easy to swallow. As the pill is easier to preserve under various external environments, the pill is a most used kind of medicine. Normally, when making up a prescription, different doses are given considering the age, the weight, and the disease severity of different patients, therefore, the pill is needed to be cut into several smaller portions. As the pill is made by pressing, it's very hard. Splitting the pill by fingers needs great effort, and often causes an imprecise dose, which has been a trouble for the user.

The pill can be grinded by a pill grinder. The existing pill grinder normally crushes and grinds the pill by rotating a cap the grinder, striking with a crushing hammer, or pressing a lever towards a platform. With the existing pill grinder, the user needs to apply a large force and the using process is hard, blunt instrument like the crushing hammer etc. also has an apparent potential risk of safety. When using a pill grinding assembly having a rolling pin, the user needs to provide a pressing force for crushing the pill and a pushing force for pushing the rolling pin forward and a pulling force for dragging the rolling pin backwards manually, the three forces are applied in three different directions, the operation process is complex, so total operation time of grinding the pill is increased, and possibility of contaminating the pill is largely increased, which is unfavorable for the patient.

SUMMARY

In the present disclosure, a pill grinder is provided, including: a base plate; a guiding assembly connected to the base plate and including an elastic returning component; a handle component including a pair of handle connecting rods, wherein, a first connecting rod is connected to a first end of each handle connecting rod, the first connecting rod is movably disposed on the guiding assembly, a roller shaft is connected between the handle connecting rods, an axial direction of the roller shaft and an axial direction of the first connecting rod are both parallel to a first direction, the elastic returning component applies a force to the first connecting rod, for keeping the first connecting rod pressed towards the base plate; and a grinding component, sleeved outside the roller shaft, wherein, when the handle component rotates around the first connecting rod, guided by the guiding assembly, the grinding component has a grinding stroke along a second direction perpendicular to the first direction, for grinding a surface of the base plate.

In the present disclosure, a method for using the pill grinder is provided, including the following steps:

putting material to be grinded in an area corresponding to the rolling stroke of the grinding roller;

repeatedly pressing a second end of the handle connecting rod towards the base plate and releasing the second end of the handle connecting rod, the grinding roller rolls back and forth along a direction parallel to the second direction, to grind the material on the base plate.

It should be readily understood that both the foregoing general description and the following detailed description are exemplary and explanatory only, and are not intended as a limitation to the scope of the present disclosure.

BRIEF DESCRIPTION OF THE DRAWINGS

The foregoing and other features, and advantages of the invention are apparent from the following detailed description taken in conjunction with the accompanying drawings in which.

DETAILED DESCRIPTION

In the following, embodiments of the present disclosure will be described in detail with reference to the figures. The concept of the present disclosure can be implemented in a plurality of forms, and should not be understood to be limited to the embodiments described hereafter. In contrary, these embodiments are provided to make the present disclosure more comprehensive and understandable, and so the conception of the embodiments can be conveyed to those skilled in the art fully. Same reference signs in the figures refer to same or similar elements, so repeated description of them will be omitted.

Besides, the technical features, assemblies, and characteristics can be combined in any appropriate way in one or more embodiments. In the following, more specific details are provided to give a full understanding to the embodiments of the present disclosure. However, those skilled in the art should realize that the technical proposal can also be released without one or more of the specific details, or with other assemblies or components. In other conditions, some common assemblies or components well known in the art are not described to avoid making the present disclosure unclear.

Figure 1:
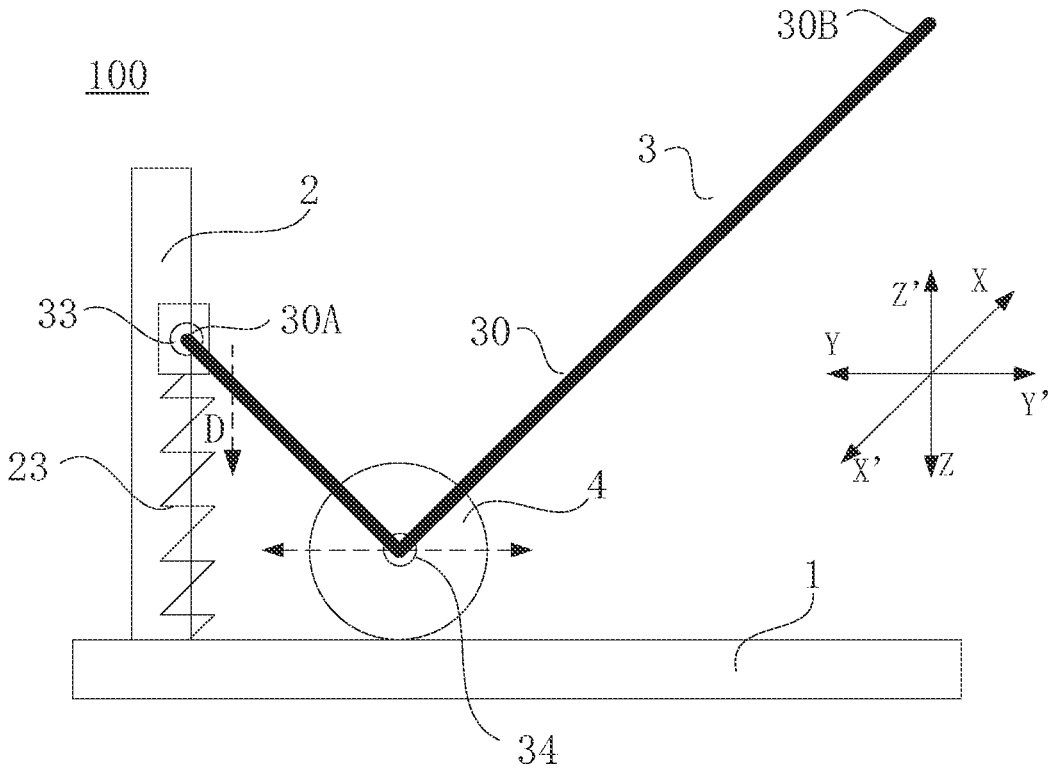
FIG. 1 is a schematic view of a pill grinder of the present disclosure.

FIG. 1 is a schematic view of a pill grinder of the present disclosure. As shown in FIG. 1, a pill grinder is provided in the present disclosure, including a base plate 1, a guiding assembly 2, a handle component 3 and a grinding component 4. The grinding component 4 can be a grinding roller or a grinding anvil, or other kinds of grinding components not described here. The guiding assembly 2 is connected to a first end 1A of the base plate 1, the guiding assembly 2 includes an elastic returning component 23, the elastic returning component 23 can be any kind of tension spring, torsion spring, and compression spring or other kind of elastic component not described here. The handle component 3 includes a pair of handle connecting rods 30, a first connecting rod 33 is connected to a first end 30A of each handle connecting rod 30, the first connecting rod 33 is movably disposed on the guiding assembly 2, and two ends of the first connecting rod 33 are limited by the guiding assembly 2, a roller shaft 34 is connected between the handle connecting rods 30, an axial direction of the roller shaft 34 and an axial direction of the first connecting rod 33 are both parallel to a first direction X, the elastic returning component 23 applies a force to the first connecting rod 33, for keeping the first connecting rod 33 pressed towards the base plate 1. The force of the elastic returning component 23 to the first connecting rod 33 can be a pulling force, a pressing force, a pushing force or other kind of force not described here. The grinding component 4 is sleeved outside the roller shaft 34. When the handle component 3 rotates around the first connecting rod 33, guided by the guiding assembly 2, the grinding component 4 has a grinding stroke along a second direction Y perpendicular to the first direction X, for grinding a surface of the base plate 1.

Figure 2:
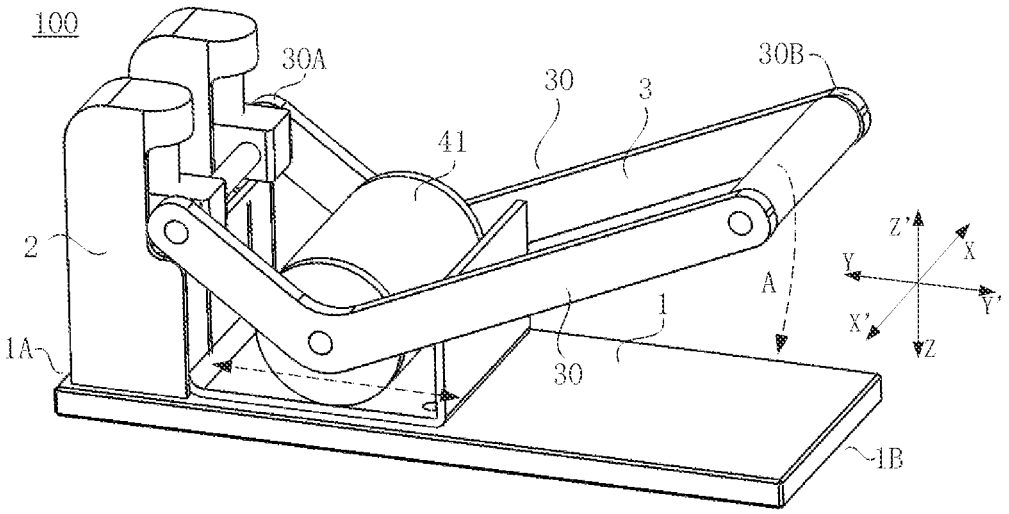
FIG. 2 is a stereogram of a first kind of pill grinder of the present disclosure.
Figure 3:
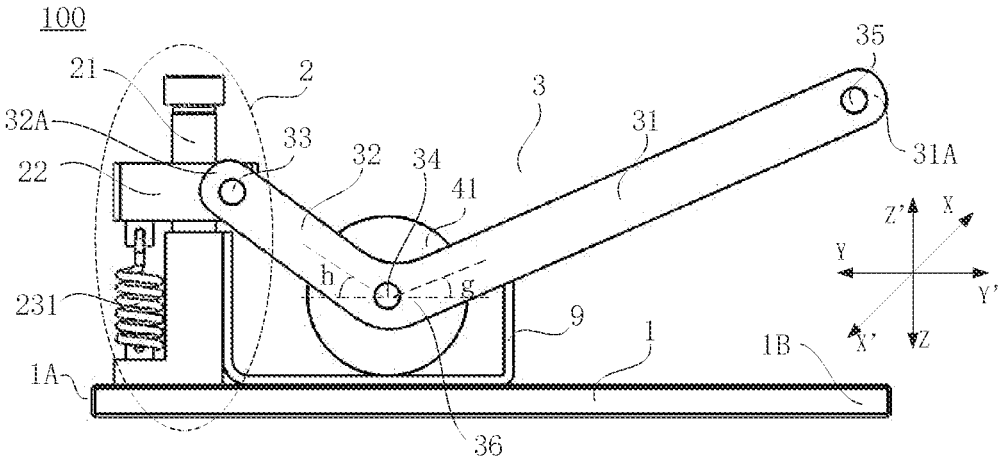
FIG. 3 is a schematic view of the first kind of pill grinder of the present disclosure without a shell.
Figure 4:
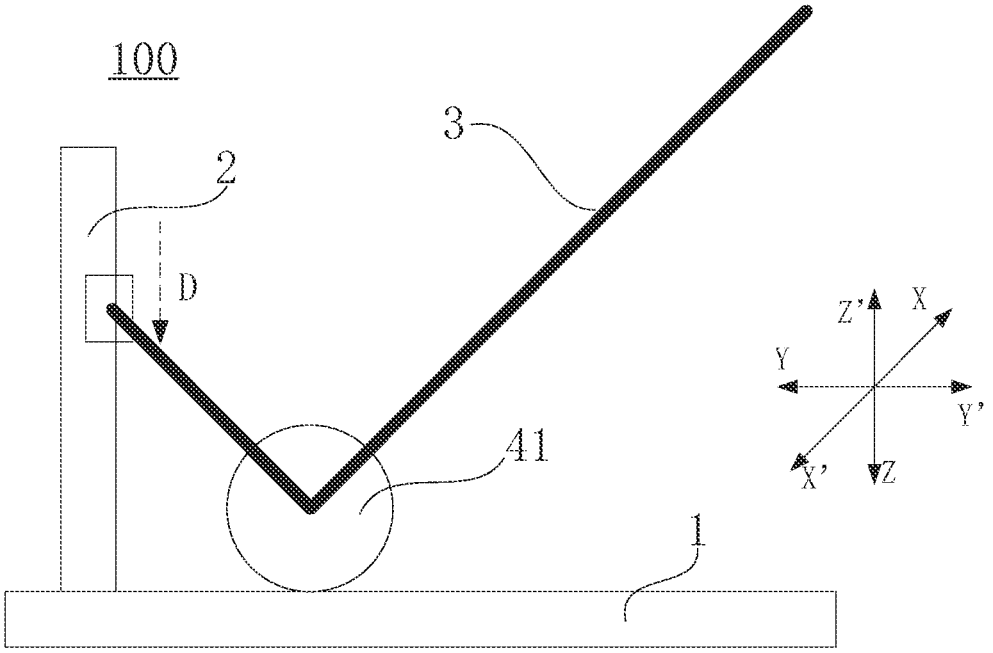
FIGS. 4-7 are schematic views of a using process of the first kind of pill grinder of the present disclosure.
Figure 5:
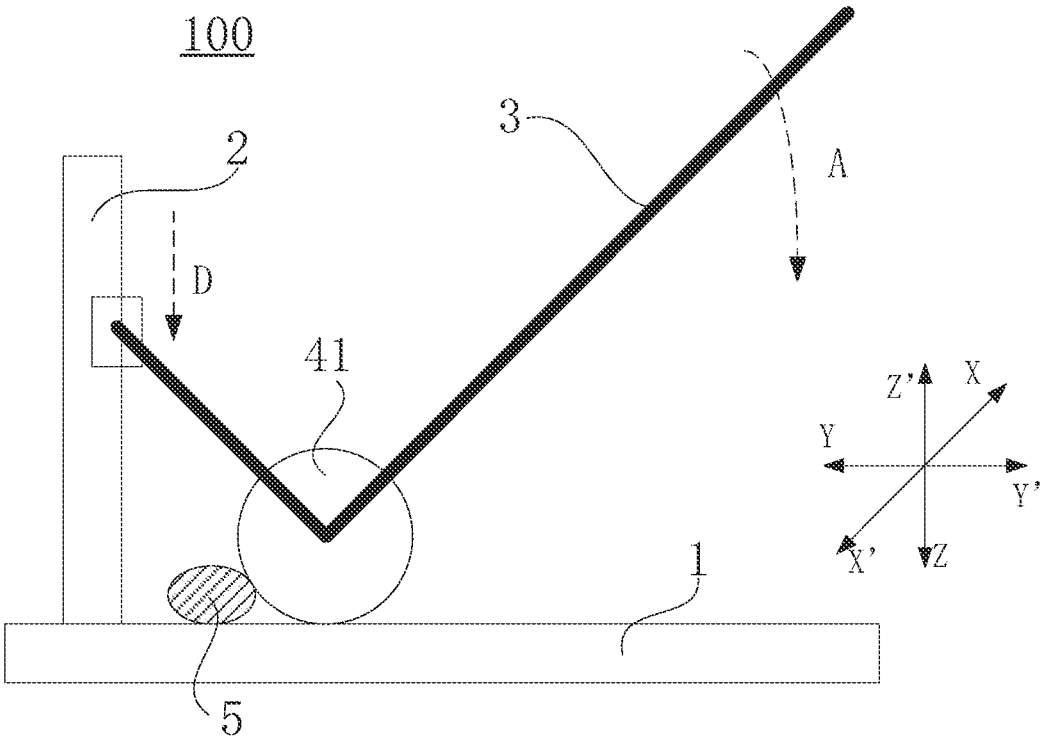
Figure 6:
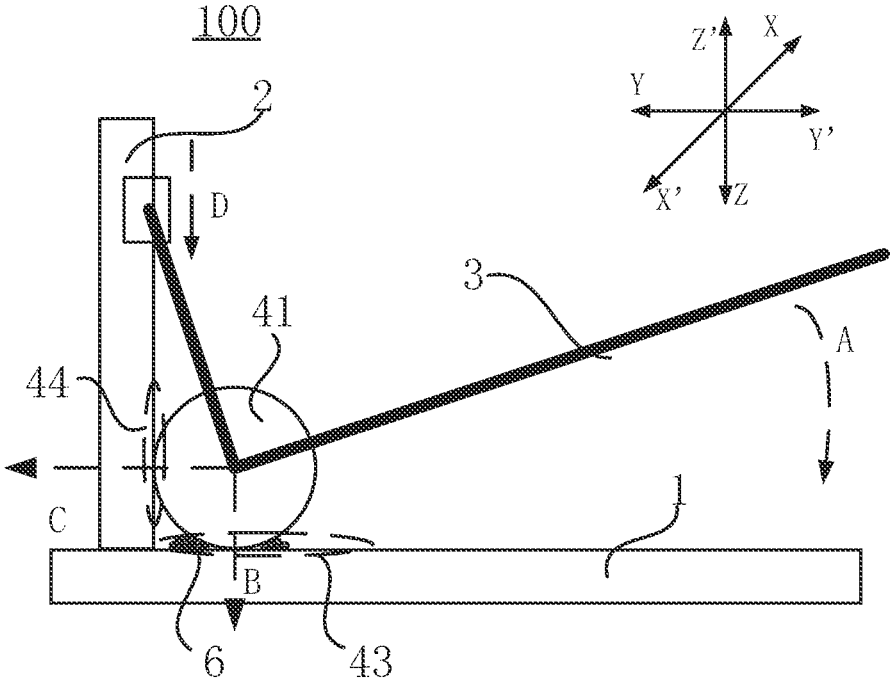
Figure 7:
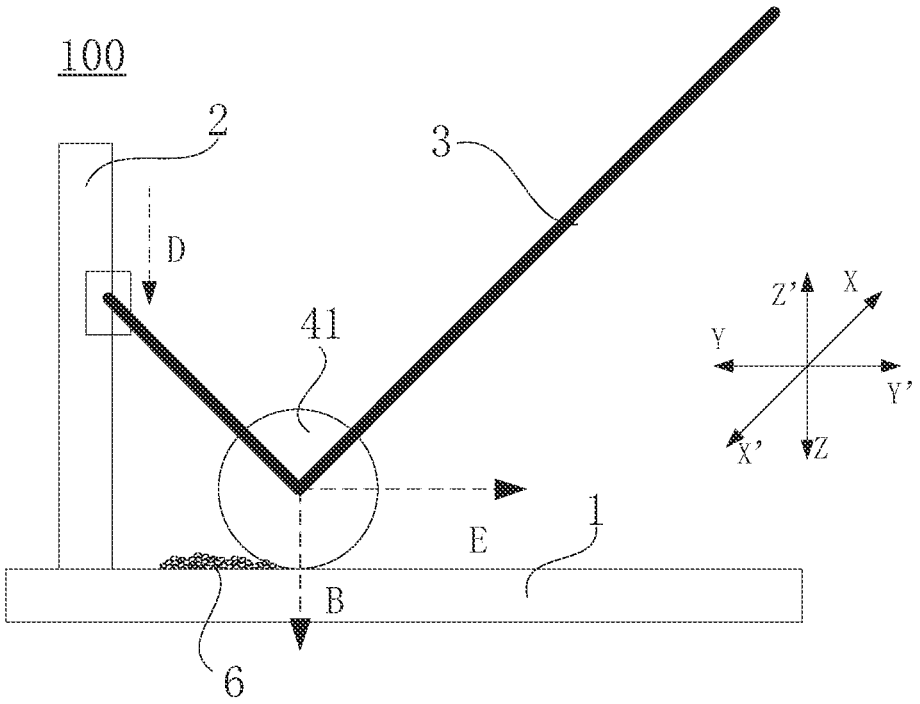

FIG. 2 is a stereogram of a first kind of pill grinder of the present disclosure. FIG. 3 is a schematic view of the first kind of pill grinder of the present disclosure without a shell. As shown in FIGS. 2 and 3, a first kind of pill grinder 100 of the present disclosure includes a base plate 1, a guiding assembly 2, a handle component 3 and a grinding roller 41. The guiding assembly 2 is connected to a first end 1A of the base plate 1, the guiding assembly 2 includes a tension spring 231. The handle component 3 includes a pair of handle connecting rods 30, a first connecting rod 33 is connected to a first end 30A of each handle connecting rod 30, the first connecting rod 33 is movably disposed on the guiding assembly 2, and two ends of the first connecting rod 33 are limited by the guiding assembly 2, a roller shaft 34 is connected between the handle connecting rods 30, an axial direction of the roller shaft 34 and an axial direction of the first connecting rod 33 are both parallel to a first direction X, the tension spring 231 applies a force to the first connecting rod 33, for keeping the first connecting rod 33 pressed towards the base plate 1. The force of the tension spring 231 to the first connecting rod 33 is a pulling force, but the present disclosure is not limited to this. The grinding roller 41 is sleeved outside the roller shaft 34. When the handle component 3 rotates around the first connecting rod 33, guided by the guiding assembly 2, the grinding roller 41 has a rolling stroke along a second direction Y perpendicular to the first direction X, for grinding a surface of the base plate 1.

When the user operates the pill grinder of the present disclosure for grinding pills, only a second end 30B of the handle connecting rod 30 is needed to be pressed towards the base plate 1 (the handle connecting rod 30 moves along a third direction Z), the second end of the handle connecting rod 30 rotates around the first connecting rod 33, so that the grinding roller 41 is controlled to roll towards the guiding assembly 2 and along the base plate 1, the force of the tension spring 231 and the pressing force of the user to the handle connecting rod 30 together form a pressing force of the grinding roller 41 to the base plate 1, at this time, guided by the guiding assembly 2, the grinding roller 41 rolls on the surface of the base plate 1 along the second direction Y, with the cooperation of the pressing force of the user to the handle connecting rod 30, material to be grinded on the base plate 1 is grinded.

In a preferable embodiment, the guiding assembly 2 includes a slider 22 having a through hole 220, the slider 22 is sleeved outside the first connecting rod 33, the force of the tension spring 231 directly acts on the slider 22. That is, the tension spring 231 apply the force to the first connecting rod 33 through the slider 22. The tension spring 231 have two ends connected to the slider 22 and the base plate 1, respectively. Therefore, the tension spring 231 keeps applying the force to the first connecting rod 33 to pull the first connecting rod 33 towards the base plate 1. But the present disclosure is not limited to this.

In a preferable embodiment, the guiding assembly 2 further includes a pair of support columns 21 connected to the base plate 1, each support column 21 extends along the third direction Z perpendicular to the base plate 1, each support column 21 is provided with one slider 22, and the slider 22 is capable of sliding up and down along a length direction (the third direction Z) of the support column 21. But the present disclosure is not limited to this.

In a preferable embodiment, the first direction X and the second direction Y are both parallel to the base plate 1, but the present disclosure is not limited to this.

In a preferable embodiment, the handle connecting rod 30 includes a first support rod 31 and a second support rod 32 connected to each other, the first support rod 31 and the second support rod 32 extend along two different directions, respectively, so that the first support rod 31 and the second support rod 32 together form a shape of a broken line, a connecting portion 36 of the first support rod 31 and the second support rod 32 protrudes towards the base plate 1 and is provided with the roller shaft 34. An end portion 31A of the first support rod 31 is connected to a handle rod 35, an end portion 32A of the second support rod 32 is connected to the first connecting rod 33. But the present disclosure is not limited to this.

In a preferable embodiment, an axial direction of the handle rod 35 is parallel to the first direction X, but the present disclosure is not limited to this.

In a preferable embodiment, the axial direction of the handle rod 35, the axial direction of the roller shaft 34, and the axial direction of the first connecting rod 33 are not in a same plane. Wherein, the axial direction of the roller shaft 34 is closer to the base plate 1, but the present disclosure is not limited to this.

During the rolling stroke, when the cylindrical grinding roller 41 rolls, a distance from the roller shaft 34 to the base plate 1 is kept equal to the radius of the round surface of grinding roller 41, the rolling shaft 34 moves along a direction parallel to the base plate 1. A first angle g is formed between the first support rod 31 and the base plate 1. A second angle h is formed between the second support rod 32 and the base plate 1. When the grinding roller 41 rolls, a changing trend of the first angle g is opposite to a changing trend of the second angle. That is, when the grinding roller 41 rolls along the second direction Y, the first angle g decreases, while the second angle h increases. When the grinding roller 41 rolls along a fifth direction Y' opposite to the second direction Y, the first angle g increases, while the second angle h decreases.

In a preferable embodiment, the base plate 1 is provided with grinding teeth 8 in an area corresponding to the rolling stroke of the grinding roller 41, and/or an outer surface of the grinding roller 41 is provided with grinding teeth 8. Therefore, when the grinding roller 8 rolls over the base plate 1, the grinding effect can be enhanced and the grinding time can be shortened. But the present disclosure is not limited to this.

In a preferable embodiment, the pill grinder further includes a grinding slot 9 located on the base plate 1, the grinding roller 41 is positioned in the grinding slot 9 and the rolling of the grinding roller 41 is limited in the grinding slot 9. But the present disclosure is not limited to this.

In a preferable embodiment, the grinding slot 9 is capable of accommodating grinded material, and the grinding slot 9 is detachable from the base plate 1. Therefore, after the material is grinded, the grinding slot 9 accommodating all grinded powders can be removed from the base plate 1, and the powders can be easily poured out from the detached grinding slot 9 for usage, but the present disclosure is not limited to this.

FIGS. 4-7 are schematic views of a using process of the first kind of pill grinder of the present disclosure. As shown in FIGS. 1, 4-7, during an initial state of the first kind of pill grinder 100, the elastic returning component 23 applies a force towards the base plate 1 to a first end 30A of the handle connecting rod 30 and the first connecting rod 33, to keep the grinding roller 41 at a position relatively away from the guiding assembly 2. The grinding roller 41 is at an initial position of the rolling stroke. The second end 30B of the handle connecting rod 30 hangs above a second end 1B of the base plate 1. A pill 5 is put in the area of the base plate 1 corresponding to the rolling stroke of the grinding roller 41, the second handle 30B of the handle connecting rod 30 is held by the user and pressed down by a pressing force A of the user to move towards the base plate 1 along the third direction Z. The force D of the elastic returning component 23 and the pressing force A of the user together form the pressing force B of the grinding roller 41 to the base plate 1. At this time, guided by the guiding assembly 2, the grinding roller 41 is applied a force C to drive the grinding roller 41 to move towards the guiding assembly 2, so the grinding roller 41 rolls towards the guiding assembly 2 and along the second direction Y with the pressing force B on the base plate 1, the first connecting rod 33 overcomes the force of the elastic returning component 23 and moves away from the base plate 1, until the first connecting rod 33 is blocked by the guiding assembly 2. Then the second end 30B of the handle connecting rod 30 is released (the user release the second end 30B of the handle connecting rod 30), the tension spring 231 returns to apply a force to drive the first connecting rod 33 to move towards the base plate 1, guided by the guiding assembly 2, the grinding roller 41 is applied a force E to drive the grinding roller 41 to move away from the guiding assembly 2, so the grinding roller 41 rolls away from the guiding assembly 2 along a fifth direction Y' opposite to the second direction Y with a pressing force on the base plate 1. The second end 30B of the handle connecting rod 30 is lifted along a sixth direction Z' opposite to the third direction Z and hangs above the second end 1B of the base plate 1. By repeatedly pressing the second end 30B of the handle connecting rod 30 towards the base plate 1 and releasing the second end 30B of the handle connecting rod 30, the grinding roller 41 rolls back and forth along a direction parallel to the second direction Y, to grind the material on the base plate 1 to pill powders 6.

Figure 8:
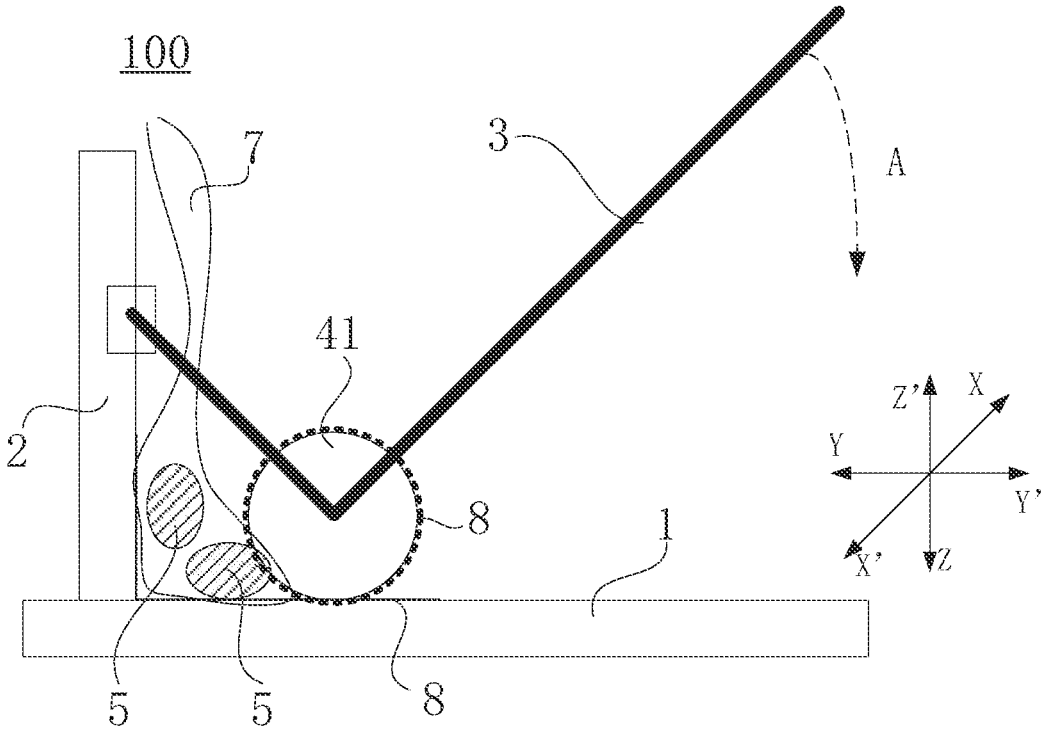
FIG. 8 is a schematic view of another using method of the first kind of pill grinder of the present disclosure.

FIG. 8 is a schematic view of another using method of the first kind of pill grinder 100 of the present disclosure. As shown in FIG. 8, a first grinding face 43 (shown in FIG. 6) is formed between the grinding roller 41 and the base plate 1, the rolling stroke of the grinding roller 41 is limited by the guiding assembly 2, and a second grinding face 44 (shown in FIG. 6) is formed between the grinding roller 41 and the guiding assembly 2. The first grinding face 43 is perpendicular to the second grinding face 44. A pill bag 7 accommodating a plurality of pills 5 can be put in an area corresponding to the first grinding face 43 and the second grinding face 44. During a rolling stroke, the grinding roller 41 firstly cooperates with the base plate 1 at the first grinding face 43 and then cooperates with the guiding assembly 2 at the second grinding face 44, for grinding the pills 5. Therefore, a length of the griding face formed by the grinding roller 41 is increased, for grinding a plurality of pills at a same time. But the present disclosure is not limited to this.

Figure 9:
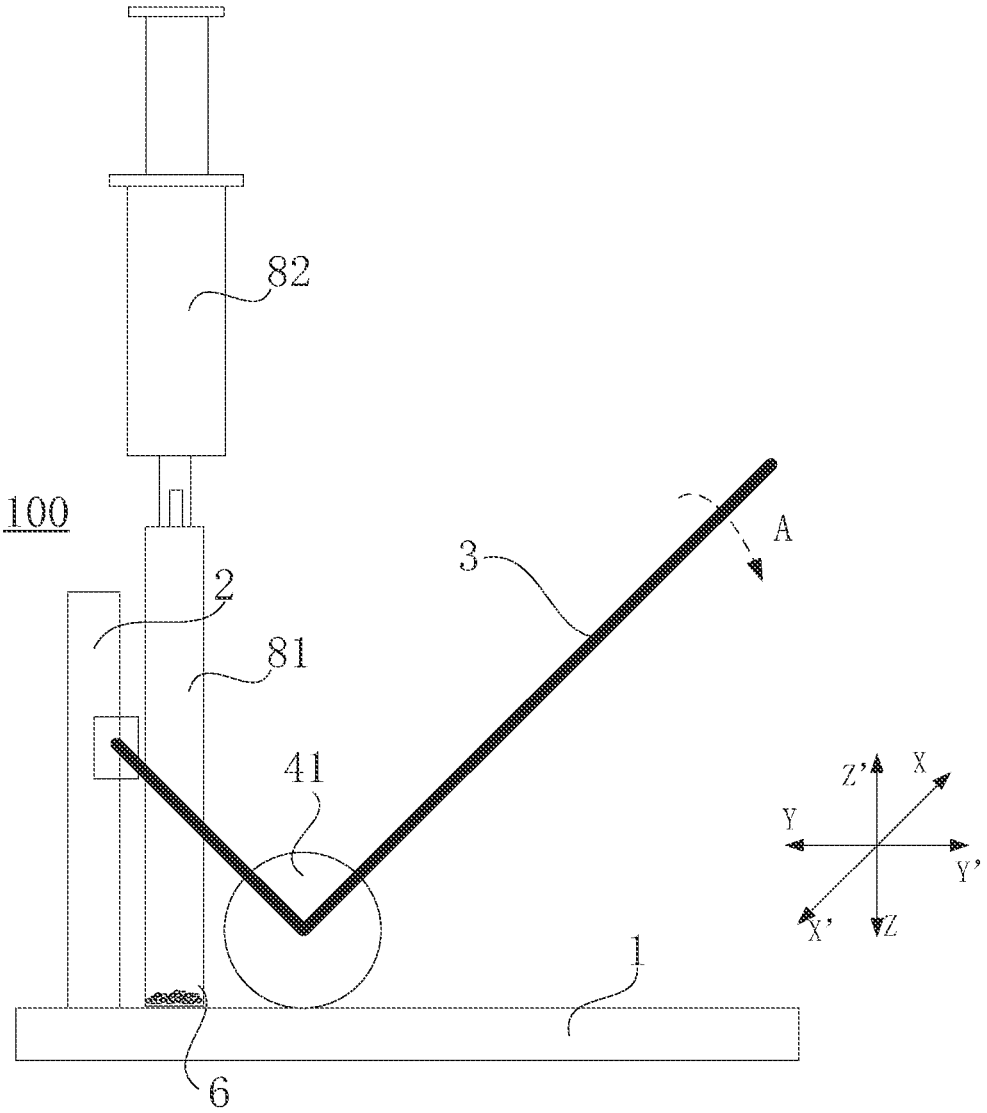
FIG. 9 is a schematic view of another using method of the first kind of pill grinder of the present disclosure.

FIG. 9 is a schematic view of another using method of the first kind of pill grinder 100 of the present disclosure. As shown in FIG. 9, the pill can be put in a pill crushing carrier 81, then the pill crushing carrier 81 is put in an area corresponding to the rolling stroke of the grinding roller 41. The area having the pill crushing carrier 81 can be an area corresponding to the first grinding face 43 (shown in FIG. 6) or an area corresponding to the second grinding face 44 (shown in FIG. 6). After the pill in the pill crushing carrier 81 is grinded to pill powders 6 by the first kind of pill grinder 100 of the present disclosure, a syringe 82 is connected to the pill crushing carrier 81 in a sealed way, the syringe 82 injects liquid into the pill crushing carrier 81 to dissolve the pill powders 6. Then the liquid is extracted back to the syringe 82, to process a following injection with the syringe 82. During the whole process of grinding and dissolving the pill, there is no contact between the pill and external environment, the powders are prevented from floating out and contamination is prevented from entering the pill crushing carrier 81, safety is ensured.

Figure 10:
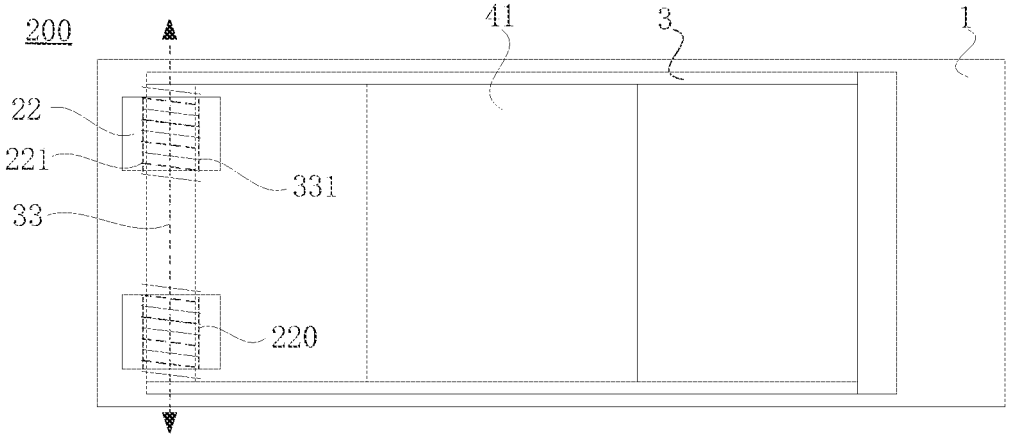
FIG. 10 is a top view of a second kind of pill grinder of the present disclosure.
Figure 11:
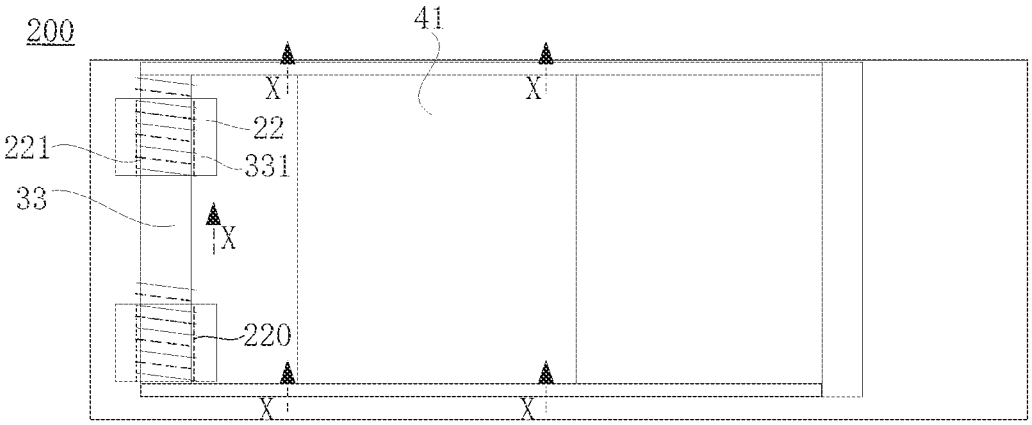
FIGS. 11-12 are schematic views of a using process of the second kind of pill grinder of the present disclosure.
Figure 12:
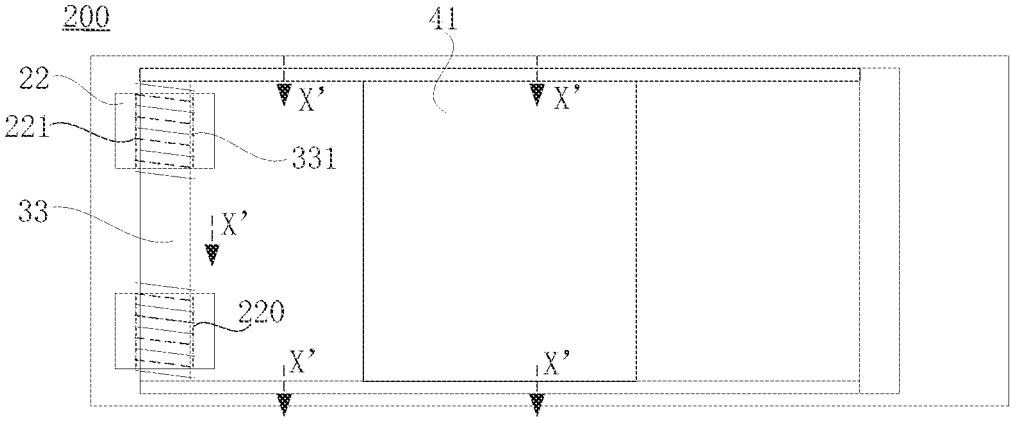

FIG. 10 is a top view of a second kind of pill grinder of the present disclosure. FIGS. 11-12 are schematic views of a using process of the second kind of pill grinder of the present disclosure. As shown in FIGS. 10-12, a difference between the second kind of pill grinder 200 and the first kind of pill grinder 100 is: in the second kind of pill grinder 200, the slider 22 cannot move along the direction X-X', the through hole 220 of the slider 22 is provided with inner threads 221, the first connecting rod 33 is provided with outer threads 331. When the handle component 3 rotates around the axial direction of the first connecting rod 33, the first connecting rod 33 moves in the through hole 220 along a direction parallel to the first direction X, so that the grinding roller 41 is dragged by the first connecting rod 33 to move along a direction parallel to the first direction X during the rolling stroke. Therefore, under the pressing force of the user to the handle connecting rod 30, the grinding roller 41 can move along the first direction X and the fourth direction X' at the same time of rolling over the base plate 1 along the second direction Y and the fifth direction Y'. The second direction Y and the fifth direction Y' are the same with the direction of the rolling stroke, the first direction X and the fourth direction X' are perpendicular to the direction of the rolling stroke.

When the second end 30B of the handle connecting rod 30 is pressed towards the base plate 1, the handle component 3 rotate around the axial direction of the first connecting rod 33, the outer threads 331 of the first connecting rod 33 rotates relative to the inner threads in the slider 22, to drive the whole first connecting rod 33 to move in the through hole 220 along the first direction X. The grinding component 4 has a grinding stroke when dragged to move along the first direction X at the same time of rolling over the base plate 1 along the second direction Y.

When the second end 30B of the handle connecting rod 30 is released and returns, the handle component 3 rotates around the axial direction of the first connecting rod 33, outer threads 331 of the first connecting rod 33 rotate relative to the inner threads 221 in the through hole 220, to drive the whole first connecting rod 33 to move in the through hold along a fourth direction X' opposite to the first direction X, so that the grinding roller 4 has a grinding stroke when dragged to move along the fourth direction X' at the same time of rolling over the base plate 1 along a fifth direction Y' opposite to the second direction Y. Therefore, the grinding roller 41 can be dragged to laterally move at the same time of rolling for grinding with a pressing force, instead of simply moving along a straight line. The grinding roller 41 can grind the pill faster with less time. The other technical features of the second kind of pill grinder 200 are the same with those of the first kind of pill grinder 100, and similar description will be omitted here.

Figure 13:
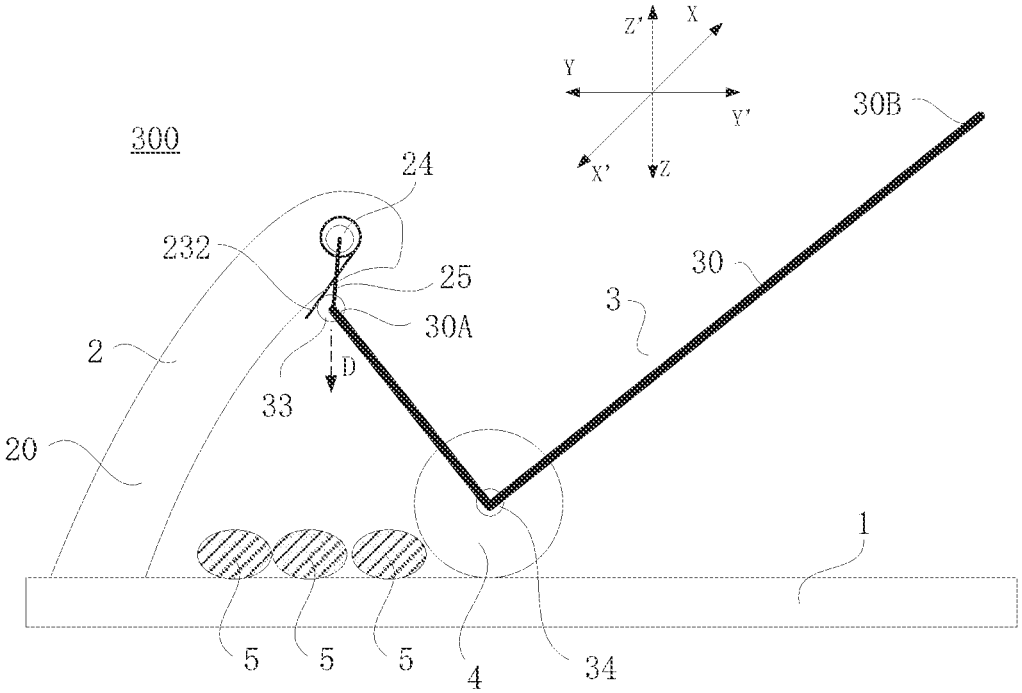
FIG. 13 is a stereogram of a third kind of pill grinder of the present disclosure.
Figure 14:
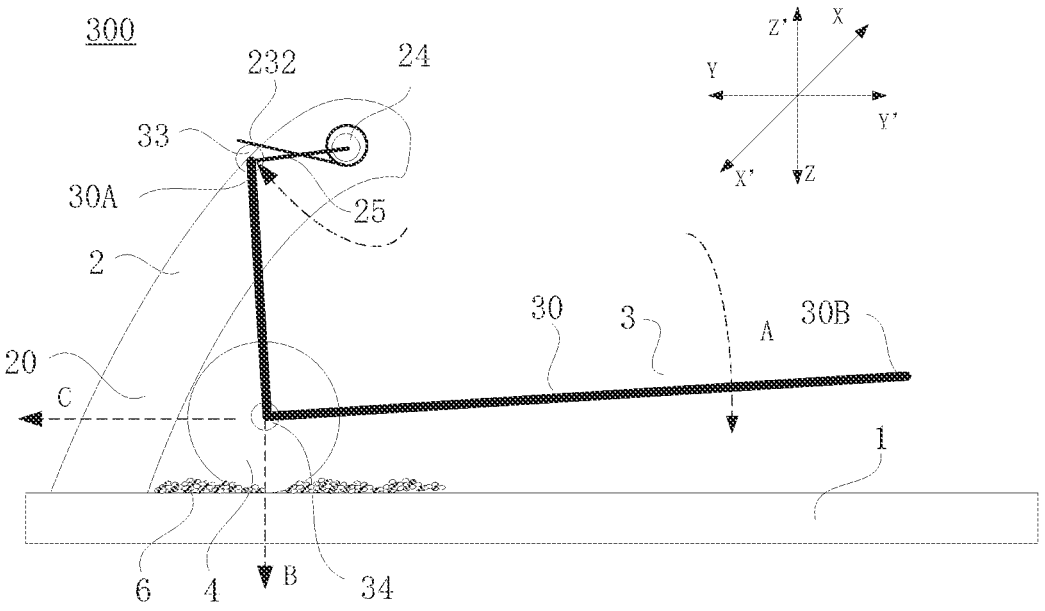
FIG. 14 is a schematic view of a using process of the third kind of pill grinder of the present disclosure.

FIG. 13 is a stereogram of a third kind of pill grinder of the present disclosure. FIG. 14 is a schematic view of a using process of the third kind of pill grinder of the present disclosure. As shown in FIG. 13 and FIG. 14, the difference between the third kind of pill grinder 300 and the first kind of pill grinder 100 is: in the third kind of pill grinder 300, the guiding assembly 2 includes a pair of support frame 20, a second connecting rod 24 and a torsion spring 232 are connected between the support frames 20, the second connecting rod 24 and the first connecting rod 33 are kept to be parallel to each other by a group of third connecting rods 25, the first connecting rod 33 is capable of swinging around the second connecting rod 24, force of the torsion spring 232 acts on the first connecting rod 33 and the second connecting rod 24, so that the first connecting rod 33 is pressed towards the base plate 1. As the first connecting rod 33 can move along a same direction with the moving direction of the grinding component 4, the first connecting rod 33 acts not only as a rotation axis for the grinding roller 41, but also as a movable shaft. When the second end 30B of the handle connecting rod 30 is pressed towards the base plate 1, the first connecting rod 33 swings around the second connecting rod 24, and moves from its initial position along the second position, to increase the grinding stroke of the grinding roller 4. When the second end 30B of the handle connecting rod 30 is released and returns, the first connecting rod 33 swings around the second connecting rod 24, until the first connecting rod is blocked and stays at its initial position. Therefore, the grinding stroke of the grinding component 4 not only includes the grinding stroke caused by the grinding roller 4 rolling around the first connecting rod 33, but also includes the displacement caused by the first connecting rod 33 moving along a same direction. Therefore, the grinding stroke of the grinding component 4 is largely increased, for enhancing the grinding effect. The other technical features of the third kind of pill grinder 300 are the same with those of the first kind of pill grinder 100, and similar description will be omitted here.

Figure 15:
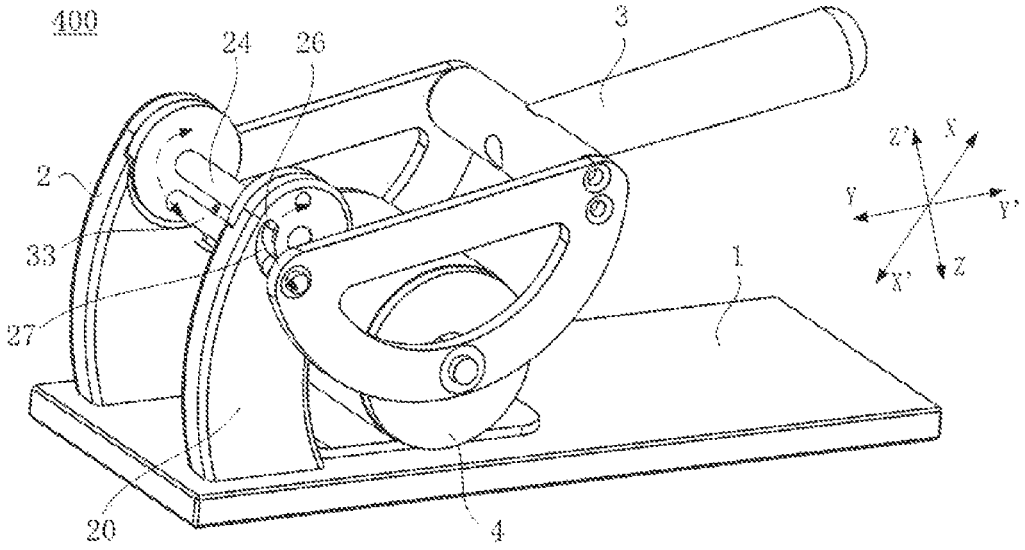
FIG. 15 is a stereogram of a fourth kind of pill grinder of the present disclosure.

FIG. 15 is a stereogram of a fourth kind of pill grinder of the present disclosure. As shown in FIG. 15, the difference between the fourth kind of pill grinder 400 and the first kind of pill grinder 100 is: in the fourth kind of pill grinder 400, the guiding assembly 2 includes a pair of support frames 20 connected to the base plate 1. A mounting cavity 27 is provided on top of each support frame 20 and a torsion spring is provided in the mounting cavity 27. A second connecting rod 24 is connected between the support frames 20. Each frame 20 is provided with an arcuate slot 26 surrounding an axial direction of the second connecting rod 24, and the two ends of the first connecting rod 33 are limited in the arcuate slot 26. The torsion spring directly acts on the first connecting rod 33 and the second connecting rod 24, to force first connecting rod 33 pressed towards the base plate 1 along the arcuate slot 26, but the present disclosure is not limited to this. The other technical features of the fourth kind of pill grinder 400 are the same with those of the first kind of pill grinder 100, and similar description will be omitted here.

Figure 16:
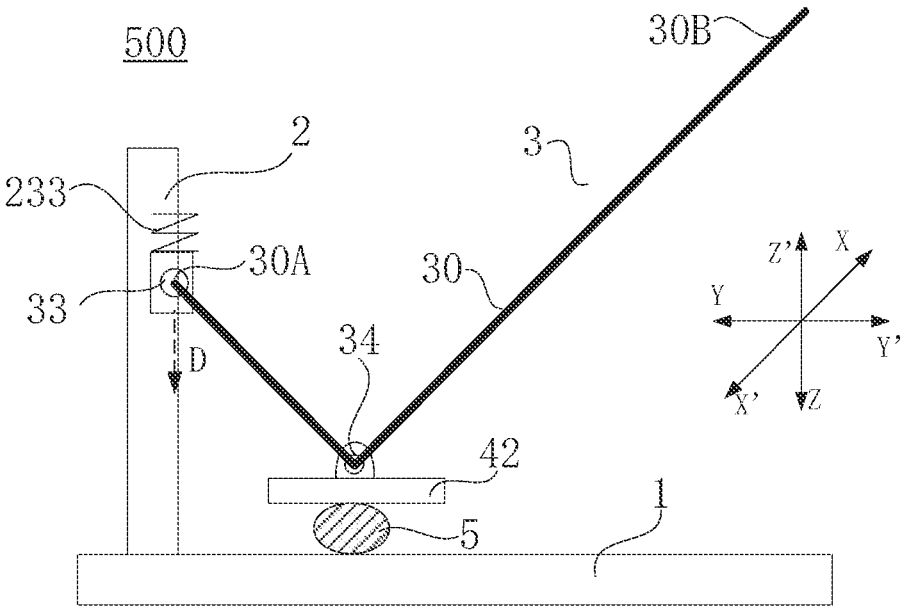
FIG. 16 is a stereogram of a fifth kind of pill grinder of the present disclosure.

FIG. 16 is a stereogram of a fifth kind of pill grinder of the present disclosure. As shown in FIG. 16, the difference between the fifth kind of pill grinder 500 and the first kind of pill grinder 100 is: in the fifth kind of pill grinder 500, the grinding component 4 is a grinding anvil 42, one side of the grinding anvil 42 is rotatably connected to the roller shaft 34, the other side of grinding anvil 42 contacts and applies a pressing force to the surface of the base plate 1, a compression spring 233 presses the first connecting rod 33 towards the base plate 1. When roller shaft 34 is pressed towards the base plate 1 and moves along a direction parallel to the base plate 1, the grinding anvil 42 slides on the surface of the base plate 1, following a moving direction of the roller shaft 34. When the handle component 3 rotates around the first connecting rod 33, guided by the guiding component 2, the grinding anvil 42 has a grinding stroke along the second direction X perpendicular to the first direction, for grinding the base plate 1 with a pressing force. When the pill grinder is used, the user only needs to press the second end 30B of the handle connecting rod 30 towards the base plate 1, then the grinding anvil 42 can be controlled to move towards the guiding assembly 2 along the base plate 1. During the process, the grinding anvil 42 and the base plate 1 cooperate and form a pair of grinding faces. Besides, the pressing force of the compression spring 233 and the pressing force of the user to the handle connecting rod 30 together form a pressing force of the grinding anvil to the base plate 1. At this time, guided by the guiding assembly 2, the grinding anvil 42 moves on the surface of the base plate 1, with the cooperation of the pressing force of the user to the handle connecting rod 30, material to be grinded on the base plate 1 is grinded. The cooperation between the grinding anvil 42 and the base plate 1 can effectively prevent the pill 5 from rolling, so round pills can be better grinded, but the present disclosure is not limited to this. The other technical features of the fifth kind of pill grinder 500 are the same with those of the first kind of pill grinder 100, and similar description will be omitted here.

Figure 17:
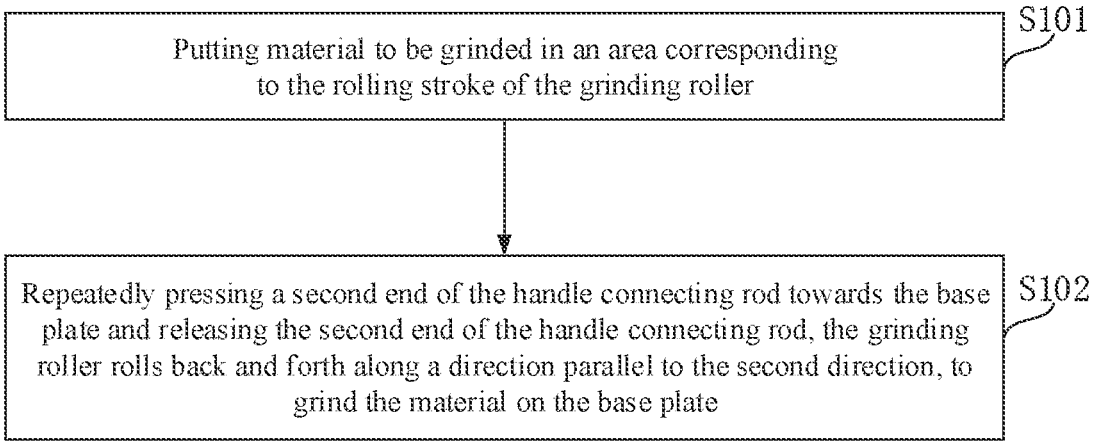
FIG. 17 is a flow chart of a method for using the pill grinder of the present disclosure.

FIG. 17 is a flow chart of a method for using the pill grinder of the present disclosure. As shown in FIG. 17, the method for using the pill grinder 100 (shown in FIGS. 1, 4-7) includes the following steps:

S101: putting material to be grinded in an area corresponding to the rolling stroke of the grinding roller 41.

S102: repeatedly pressing a second end 30B of the handle connecting rod 30 towards the base plate 1 and releasing the second end 30B of the handle connecting rod 30, the grinding roller 41 rolls back and forth along a direction parallel to the second direction, to grind the material on the base plate 1. Wherein, when the second end 30B of the handle connecting rod 30 is pressed towards the base plate 1, the grinding roller 41 rolls towards the guiding assembly 2 and along the base plate 1, the first connecting rod 33 overcomes the force of the elastic returning component 23 and moves away from the base plate 1. After the second end of the handle connecting rod 30 is released, the elastic returning component 23 returns and drives the first connecting rod 33 to move towards the base plate 1, the grinding roller 41 rolls away from the guiding assembly 2 and along the base plate 1, the second end 30B of the handle connecting rod 30 hangs above the base plate 1.

Above all, using the pill grinder in the present disclosure, the pills can be better grinded with easier operation and less time. In some embodiments, the grinding component can move along a plurality of different directions during the rolling stroke for pill grinding, the grinding component can be dragged to laterally move at the same time of rolling with a pressing force for pill grinding, the grinding effect is largely enhanced, and safety of using the pill grinder is largely enhanced.

The above is a detailed description of the present disclosure in connection with the specific preferred embodiments, and the specific embodiments of the present disclosure are not limited to the description. Modifications and substitutions can be made without departing from the spirit and scope of the present disclosure.

What is claimed is:

1. A pill grinder, comprising:

a base plate;

a guiding assembly connected to the base plate and comprising an elastic returning component;

a handle component comprising a pair of handle connecting rods, wherein, a first connecting rod is connected to a first end of each handle connecting rod, the first connecting rod is movably disposed on the guiding assembly, a roller shaft is connected between the handle connecting rods, an axial direction of the roller shaft and an axial direction of the first connecting rod are both parallel to a first direction, the elastic returning component applies a force to the first connecting rod, for keeping the first connecting rod pressed towards the base plate; and a grinding component, sleeved outside the roller shaft, wherein, when the handle component rotates around the first connecting rod, guided by the guiding assembly, the grinding component has a grinding stroke along a second direction perpendicular to the first direction, for grinding at least one pill on a surface of the base plate to pill powders.

2. The pill grinder of claim 1, wherein, the grinding component comprises a grinding roller sleeved outside the roller shaft, an outer surface of the grinding roller contacts with and applies a pressing force to the surface of the base plate;

when the roller shaft is pressed towards the base plate and moves along a direction parallel to the base plate, the grinding roller rolls on the surface of the base plate, following the moving direction of the roller shaft, so that the grinding roller has a rolling stroke along a direction parallel to the base plate, for grinding at least one pill on a surface of the base plate to pill powders.

3. The pill grinder of claim 2, wherein, when a second end of the handle connecting rod is pressed towards the base plate, the grinding roller rolls towards the guiding assembly and along the base plate, the first connecting rod overcomes the force of the elastic returning component and moves away from the base plate;

when the second end of the handle connecting rod is released and returns, the elastic returning component returns and drives the first connecting rod to move towards the base plate, the grinding roller rolls away from the guiding assembly and along the base plate, and the second end of the handle connecting rod hangs above the base plate.

4. The pill grinder of claim 1, wherein, the guiding assembly comprises a slider having a through hole, the slider is sleeved outside the first connecting rod, the force of the elastic returning component acts on the slider;

the elastic returning component is a tension spring having two ends connected to the slider and the base plate, respectively.

5. The pill grinder of claim 4, wherein, the guiding assembly further comprises a pair of support columns connected to the base plate, each support column extends along a third direction perpendicular to the base plate, each support column is provided with one slider, and the slider is capable of sliding along a length direction of the support column.

6. The pill grinder of claim 4, wherein, the handle connecting rod comprises a first support rod and a second support rod connected to each other, the first support rod and the second support rod extend along two different directions, respectively, a connecting portion of the first support rod and the second support rod protrudes towards the base plate and is provided with the roller shaft;

an end portion of the first support rod is connected to a handle rod, an end portion of the second support rod is connected to the first connecting rod.

7. The pill grinder of claim 6, wherein, the first direction and the second direction are both parallel to the base plate, an axial direction of the handle rod is parallel to the first direction, the axial direction of the handle rod, the axial direction of the roller shaft, and the axial direction of the first connecting rod are not in a same plane.

8. The pill grinder of claim 4, wherein, the through hole of the slider is provided with inner threads, the first connecting rod is provided with outer threads;

when the handle component rotates around the axial direction of the first connecting rod, the first connecting rod moves in the through hole along a direction parallel to the first direction, so that the grinding roller is dragged by the first connecting rod to move along a direction parallel to the first direction at the same time of rolling over the base plate along the second direction.

9. The pill grinder of claim 5, wherein, when a second end of the handle connecting rod is pressed towards the base plate, the first connecting rod moves in the through hole along the first direction, so that the grinding roller has a grinding stroke when dragged to move along the first direction at the same time of rolling over the base plate along the second direction;

when the second end of the handle connecting rod is released and returns, the first connecting rod moves in the through hole along a fourth direction opposite to the first direction, so that the grinding roller has a grinding stroke when dragged to move along the fourth direction at the same time of rolling over the base plate along a fifth direction opposite to the second direction.

10. The pill grinder of claim 1, wherein, the guiding assembly comprises a pair of support frames connected to the base plate, a second connecting rod and a torsion spring are connected between the support frames, the second connecting rod and the first connecting rod are kept to be parallel to each other by a group of third connecting rods, the first connecting rod is capable of swinging around the second connecting rod, force of the torsion spring acts on the first connecting rod and the second connecting rod, so that the first connecting rod is pressed towards the base plate.

11. The pill grinder of claim 10, wherein, when a second end of the handle connecting rod is pressed towards the base plate, the first connecting rod swings around the second connecting rod, and moves from its initial position along the second direction, so that the grinding stroke of the grind component is increased;

when the second end of the handle connecting rod is released to return, the first connecting rod swings around the second connecting rod, until the first connecting rod is blocked and stays at its initial position.

12. The pill grinder of claim 2, wherein, the base plate is provided with grinding teeth in an area corresponding to the rolling stroke of the grinding roller, and/ or an outer surface of the grinding roller is provided with grinding teeth;

a first grinding face is formed between the grinding roller and the base plate, the rolling stroke of the grinding roller is limited by the guiding assembly, and a second grinding face is formed between the grinding roller and the guiding assembly.

13. The pill grinder of claim 2, wherein, further comprises a grinding slot located on the base plate, the grinding roller is positioned in and limited by the grinding slot, the grinding slot is capable of accommodating grinded material, and the grinding slot is detachable from the base plate.

14. The pill grinder of claim 1, wherein, the grinding component comprises a grinding anvil, one side of the grinding anvil is rotatably connected to the roller shaft, the other side of grinding anvil contacts with and applies a pressing force to the surface of the base plate;

when the roller shaft is pressed towards the base plate and moves along a direction parallel to the base plate, the grinding anvil slides on the surface of the base plate, following a moving direction of the roller shaft.

15. A method for using the pill grinder of claim 2, comprising the following steps:

putting material to be grinded in an area corresponding to the rolling stroke of the grinding roller;

repeatedly pressing a second end of the handle connecting rod towards the base plate and releasing the second end of the handle connecting rod, the grinding roller rolls back and forth along a direction parallel to the second direction, to grind the material on the base plate.

16. The method of claim 15, wherein, when the second end of the handle connecting rod is pressed towards the base plate, the grinding roller rolls towards the guiding assembly and along the base plate, the first connecting rod overcomes the force of the elastic returning component and moves away from the base plate;

when a second end of the handle connecting rod is released, the elastic returning component returns and drives the first connecting rod to move towards the base plate, the grinding roller rolls away from the guiding assembly and along the base plate, and the second end of the handle connecting end hangs above the base plate.

* * * * *